United States Patent [19]

Rookus

[11] 3,940,851

[45] Mar. 2, 1976

[54] HAIR-RAISING PANEL FOR ELECTRIC RAZOR

[76] Inventor: James E. Rookus, 505 Cherry, SE., Grand Rapids, Mich. 49503

[22] Filed: June 12, 1974

[21] Appl. No.: 478,620

[52] U.S. Cl. ..... 30/34.2; 30/90

[51] Int. Cl.[2] ..... B26B 19/42

[58] Field of Search ..... 30/34.2, 43.92, 43.91, 30/90

[56] References Cited

UNITED STATES PATENTS

| | | | |
|---|---|---|---|
| 2,083,580 | 6/1937 | Schmitt | 30/90 |
| 2,205,590 | 6/1940 | Bowman | 30/34.2 |
| 2,275,810 | 3/1942 | Weiland | 30/34.2 |
| 2,343,705 | 3/1944 | Rand | 30/34.2 |
| 2,670,584 | 3/1954 | Haber | 30/34.2 |
| 2,852,845 | 9/1958 | Scully | 30/34.2 |
| 3,166,842 | 1/1965 | Christensen et al. | 30/43.1 |
| 3,834,017 | 9/1974 | Tolmie | 30/34.2 |

FOREIGN PATENTS OR APPLICATIONS

| | | | |
|---|---|---|---|
| 523,492 | 7/1940 | United Kingdom | 30/34.2 |
| 731,123 | 6/1955 | United Kingdom | 30/34.2 |

*Primary Examiner*—Francis S. Husar
*Assistant Examiner*—Marc R. Davidson
*Attorney, Agent, or Firm*—Price, Heneveld, Huizenga & Cooper

[57] ABSTRACT

A panel like member is provided for an electric shaver which seats against the side of the shaver screen which panel has a straight top in or just below the shearing plane of the blade for positioning the hairs as they enter the screen such that they will be sheared by the blade.

13 Claims, 7 Drawing Figures

HAIR-RAISING PANEL FOR ELECTRIC RAZOR

BACKGROUND OF THE INVENTION

Electric shavers have a stationary apertured screen or guard behind which a driven blade is reciprocated or rotated to shave the user by shearing the individual hairs which project through the openings in the screen. The cutting blade is caused to move rapidly while pressed against the inside surface of the screen. The cutting blade has openings which permit the hairs which pass through the screen to also pass through the cutting blade whereby the hairs are sheared as the cutting blade passes across the screen openings. These openings are in the top of the screen and extend down the sides of the screen below the plane of the inside surface of the screen where the shearing action takes place.

For efficient shaving, ideally, the hairs should be erect and generally normal to the skin. However, this is an ideal only, since in many cases the hair grows at an acute angle to the skin, and, therefore, as the shaver head approaches the hair, the hair is folded down between the exterior surface of the screen and the skin surface and never passes through the screen openings. The result is a poor shave, because only a portion of the hairs are actually cut. This has been the source of considerable irritation and frustration to both the users and the manufacturers of the equipment.

SUMMARY OF THE INVENTION

The invention provides a simple and relatively inexpensive accessory which may be added to the conventional electric shaver. The invention forces the hairs to stand erect as the leading edge of the shaver approaches them whereby they are positively positioned to enter the openings in the screen and be sheared. The invention accomplishes this by providing a plate or panel which overlies the exterior surface of the screen and also partially overlies that portion of the screen openings which extend down the side of the screen. This edge catches the hairs which are lying at an acute angle to the skin surface and tips them into an erected position just as they enter the screen openings. Because of the relative planar positions of the edge of this panel, and the effective shearing plane of the cutter blade, the hairs have no opportunity to return to their original position prior to being subjected to the shearing action of the blade. The construction of the invention is such that it may be added, as an accessory, to existing electric shavers without requiring redesign of the shaving head.

The invention will be more clearly understood upon reading the following description and the accompanying drawings.

DESCRIPTION OF THE PREFERRED EMBODIMENTS

Figure 1:
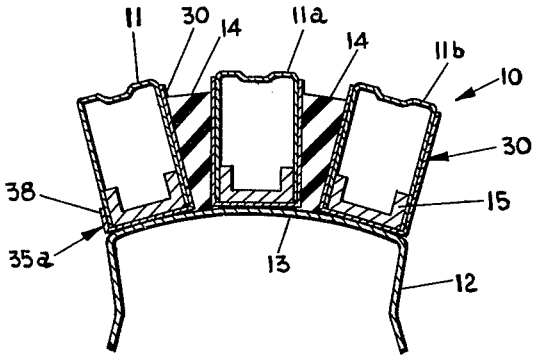
FIG. 1 is an enlarged sectional elevation view of a plural bladed shaver head showing the invention mounted on each of the individual screens of the head.

The numeral 10 indicates a shaver head having plural cutters. The shaver head has a plurality of screens 11, 11*a* and 11*b*, all mounted on a support bracket 12. The means of mounting is not illustrated since it is conventional and varies from one shaver brand to another. Further, it does not form any part of this invention. In this particular construction, the screens are arranged on an arched surface 13 to improve shaving action and the wedge shaped spaces between the screens are occupied by suitable fillers 14.

Figure 4:
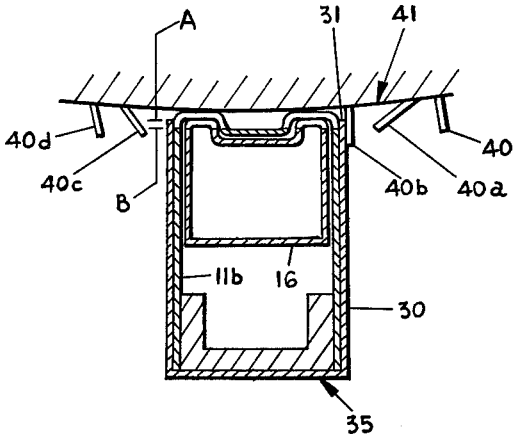
FIG. 4 is an enlarged, sectional elevation view of this invention mounted on a shaver screen illustrating the manner of its operation.
Figure 5:
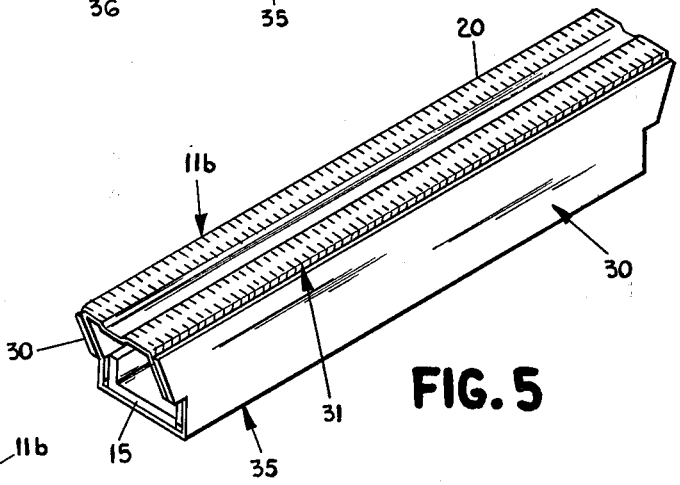
FIG. 5 is an oblique view of the invention mounted on a typical electric shaver screen.

The individual screens are of a generally inverted U-shape with the lower ends of the legs joined by a connecting member 15. As shown in FIG. 4, mounted within the screen is a cutting blade 16. The cutting blade is resiliently pressed against the inside surface of the screen by suitable means such as coil or leaf springs. These are not illustrated since the springs are conventional, are found in commercial products, and do not form any part of this invention.

The shaver head 10 is detachably mounted on a conventional shaver body which contains a motor and means extending into the shaver head to drive the cutting blade. In the particular form of shaver illustrated, the blade is reciprocated lengthwise of the screens. In other types of electric shavers the screen is circular and the blade is rotated. Again, this is conventional structure and is not a part of this invention.

Figure 6:
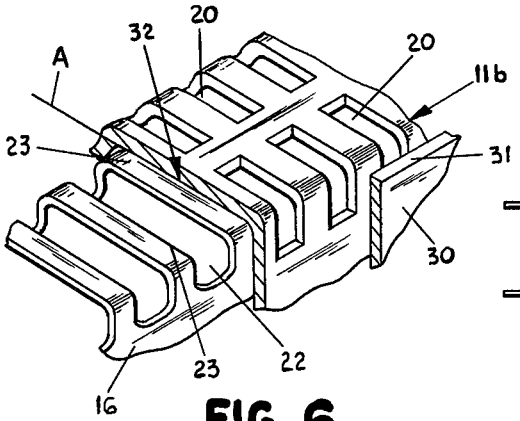
FIG. 6 is a very much enlarged, fragmentary, oblique view of the interrelationship of the top edge of the panel of this invention and the screen openings and top surface of the cutter blade.
Figure 3:
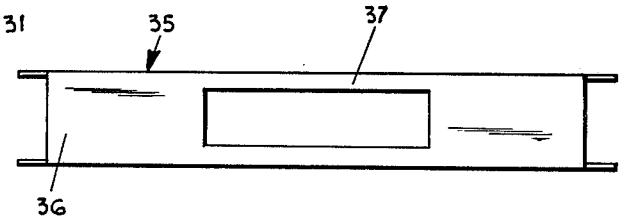
FIG. 3 is a bottom view of the panel shown in FIG. 2.

The top surface of the screen is provided with numerous, narrow, closely spaced, parallel openings 20. These openings extending to the outer side edges of the screen and then extend partially down the sides of the screen to form side portion openings as are shown in FIGS. 4 and 6. The blade 16 within the screen, also has openings 22 which extend through the top of the blade and also a portion of the distance down the sides of the blades. The top edges of each of these openings are so shaped as to form cutting edges 23 on each side. As the blade 16 is moved back and forth past the openings 20 of the screen, hairs projecting through the openings in the screen are caught in the openings 22 of the blade and, by virtue of the cutting edges 23, are sheared.

Up to this point in the description, everything that has been described is conventional and can be found in one or more of the various makes of electric shavers commercially available on the market. This invention modifies the screen blade combination by providing a plate or panel 30 which seats tightly against the exterior surface of the screen. The top edge 31 of the panel 30 has a sharp corner (FIG. 6) at the juncture of the top face and the exterior face of the panel. The top edge 31 is straight and is positioned intermediate the bottoms of the side portions of the screen openings 20 and the inside surface 32 of the top of the screen. This surface lies in the plane A (FIG. 6), which plane not only is the inside surface of the top of the screen but is also the top surface of the cutter blade and, therefore, is the plane in which the cutting edges 23 perform their shearing function as they pass back and forth across the openings 20. The bottoms of the openings 22 are also arranged in a plane which is indicated by the letter B in FIG. 4. In FIG. 4 the spacing between the planes A and B is indicated. The preferred position for the top edge 31 of the panel 30 is in the plane A where it lies in the same plane as the inside surface 32 of the screen or, stated another way, in the same plane as the top of the cutting blade 16.

Figure 2:
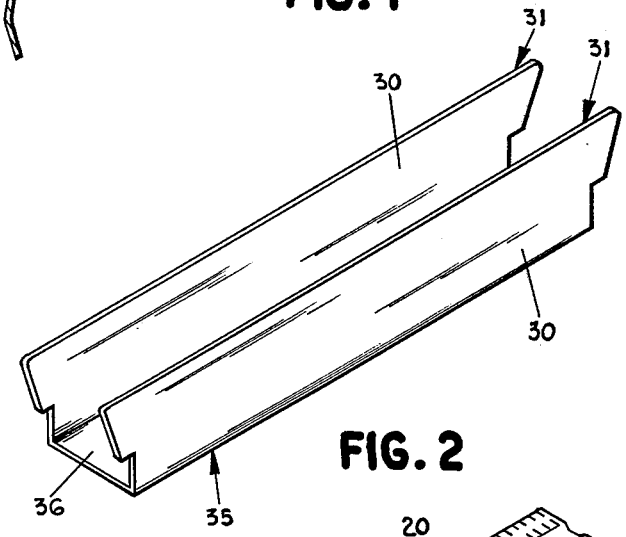
FIG. 2 is an oblique view of one form of the hair erecting panel of this invention.

The panel 30 may be a simple plate secured in any suitable manner such as by adhesives or fasteners to the side wall of the screen. A preferred embodiment, however, is that of a U-shaped member 35 as illustrated in FIG. 2. The U-shaped member consists of a pair of panels 30 integrally connected by a base portion 36. The top edges 31 of the U-shaped member 35 are in the same plane and, as is clearly illustrated in FIG. 4, they partially overlie the lower part of the side portions of the screen openings when the screen is seated within the member 35 and bottomed against its base 36. The spacing between the panels 30 of the member 35 is such as to snugly receive the screen between them. The length of the member is at least that which will assure the top edges 31 extending to and beyond the end ones of the openings 20 in the screen. The precise length and depth of the member 35 will depend upon the length and depth of the screen and blade combination with which this invention is to be used.

The base 36 of the member 35 has a central aperture 37 to permit the driving finger or shaft of the shaver motor to project up into the blade-screen combination where it can engage and drive the blade.

A modified form of the invention is illustrated on the left hand side of FIG. 1 where the member 35*a* has one panel 30 of the type and height which has previously been described but the other side of the base portion has only a short, upstanding, integral flange 38. The height of this flange is only that which is sufficient to properly grip the screen 11 and firmly hold the member 35*a* in place. The reason for this modification is that while this invention greatly improves the shaving action of the shaver, it interfers with the use of the shaver as a trimmer. In this latter case, the hair is usually of a substantial length and the use of this invention interfers with the longer hairs entering the openings in the screen. Thus, by leaving one side open, the shaver can be improved in its shaving action without impairing its utility as a trimmer. Since the other blade screen combinations of the same head have top edges 31 of the members 35 at the normal height, the shaver is capable of lifting the hairs when shaving as the shaver is moved in both directions.

It will be seen that the invention is a simple attachment which can be mounted on the conventional shaver screen-blade combination and need not have any special attachment means since the snug fit between the screen and the member will hold it in position. Since the screen is bottomed in the U-shaped member, the position of the top surface is automatically indexed at the plane A. The member 35 can be made of any suitable material but preferably is formed from stainless steel for appearance, durability and sanitation.

The principle of operation of the invention is illustrated in FIG. 4. In this figure, the individual hairs 40 through 40*d* are illustrated in various angular relationships to the skin surface 41. It will be noted that some of the hairs are growing at an angle to the skin surface such as the hairs 40*a*, 40*c* and 40*d*. It is assumed that the hair 40*b* was originally inclined in the same direction as hair 40*a*. It is illustrated as about to enter the shaver as the shaver is being moved to the right. As the top edge 31 of the panel 30 engaged the end of the hair 40*b* it pushed the hair into an erected position by tipping it outwardly from the skin. Thus, the entire hair will be positioned, ready for cutting, rather than either passing between the exterior surface of the screen and the skin surface or only a portion of it projecting into the shearing plane A of the shaver.

As the hair 40*a* passes over the edge 31 of the panel 30, it will be bent in the opposite direction, that is, to the right as the invention is illustrated in FIG. 4. When the end of the hair has passed into the shaver beyond the top edge 31 of the panel, the natural resilience of the hair will tend to snap it back to its original, inclined position. As it does so, the blade will catch it and shear it. In the case of hairs inclined in the opposite direction, as in the case of hairs 40*c* and 40*d*, movement of the shaver in the opposite direction will result in their erection and thus will be sheared in the same manner as the hair 40*b*.

It will be seen that the use of the member 35*a* will not impair this action since hair passed over by the first screen-blade combination will be erected and sheared by the next two screen-blade combinations equipped with members 35.

It will be noted that the juncture of the top and sides of the screen is rounded. This is done to avoid the harsh scraping action which would result from the use of a sharp corner. This rounded juncture, however, tends to push the inclined hairs down against the skin since it has the effect of rolling over them. This invention provides a sharp-cornered leading edge 31 which eliminates this rolling action. Because this sharp corner 31 is recessed slightly below the exterior top surface of the screen it is prevented from scraping or irritating the skin but, at the same time, it is close enough to the skin surface to catch the hair and force it into erected position. Its sharpness eliminates the "rolling-over" action of the leading edge of the screen.

Figure 7:
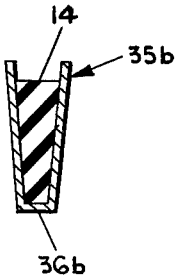
FIG. 7 is a cross-sectional view of a modified form of this invention.

FIG. 7 illustrates a modified form of this invention particularly adapted to the multiple blade-type shaver illustrated in FIG. 1. In this construction, the member 35*b* instead of being seated around the screen-blade assembly forms a V-shaped jacket around the spacer-filler 14. The height of the sides of the member 35*b* is such that their top edges are in the same position as the top edges of the member 35 and thus function in the same manner. The sides form a channel which snugly receives the filler. The member 35*b* is positively positioned with respect to the screen-blade combination since the bottom 36*b* of the member seats against the support bracket 12. Since the top of the filler 14 is recessed, it will not interfere with the member's function. The thickness of the filler 14 holds the sides of the member firmly against the sides of the adjacent screens. When this modified arrangement is used both leading edges of the shaver head will function as trimmers and the close shaving action will be performed by the inner edges of the screen-blade combination.

It will be seen that by the use of this invention a very close shave can be obtained quickly by passing the head back and forth across the skin surface. Further, the shaver will be much more complete since all of the hairs will be positioned such that they will be sheared. The invention is useful not only in the case of hairs which are growing at an angle, but also in the case of hair which is extremely fine and therefore lacks the necessary stiffness to stand erect. This type of hair tends to lay over toward the skin, and this invention will force these hairs into an outwardly projecting posture where they will be sheared by the blade.

It will be recognized that this invention can be applied to various types and makes of electric shavers either as original equipment or as an accessory to modify existing shaver heads. As such, the invention solves a problem which has not heretofore been satisfactorily answered in the electric shaver art.

The embodiments of the invention in which an exclusive property or privelege is claimed are defined as follows:

1. In a cutting head for an electric shaver having a thin screen and a driven cutting blade movably mounted within and engaging the inside surface of said screen, the screen having a top surface and a pair of sides, a plurality of openings through the top of said screen, portions of said openings extending down said sides through which individual hairs may pass to be sheared by said blade, the improvement in said cutting head comprising: a thin panel of rigid material extending parallel to and seated tightly against a side face of said screen, the top edge of said panel abutting said side face of said screen and being parallel with the top surface of said screen and in the same general horizontal plane as the inside surface of the top of said screen and overlying the lower part of those portions of said openings extending down said side of said screen for erecting individual hairs into a posture generally normal to the skin as the hairs pass into the openings in the screen for shearing by the blade.

2. The improvement in electric shaver cutting heads as described in claim 1, wherein a pair of said panels are provided, one on each side of said screen.

3. The improvement in electric shaver cutting heads as described in claim 1 wherein said panel has an integral base portion generally normal to the plane of said panel and projecting from the lower edge of said panel, an upturned flange integral with an edge of said base portion parallel with said panel and spaced therefrom a distance such that said screen may be snugly seated between said panel and said flange, said flange being shorter than said panel and no portion thereof overlying any of said openings in said screen.

4. The improvement in electric shaver cutting heads as described in claim 3 wherein an access opening is provided in said base portion to permit said blade and the drive of the shaver to be connected.

5. The improvement in electric shaver cutting heads as described in claim 1 wherein said panel has an integral base portion generally normal to the plane of said panel and projecting from the lower edge of said panel, an upturned flange integral with an edge of said base portion parallel with said panel and spaced therefrom a distance such that said screen may be snugly seated between said panel and said flange with said flange extending parallel to and seated tightly against the adjacent face of said screen, said flange being the same height as said panel, abutting the adjacent face of said screen and serving as a second panel for erecting hairs when the direction of movement of the shaver over the skin surface is reversed.

6. In a cutting head for an electric shaver having a thin screen and a driven cutting blade movably mounted within and engaging the inside surface of said screen, the screen having a top surface and a pair of sides, a plurality of openings through the top of said screen, portions of said openings extending down said sides through which individual hairs may pass through said screen to be sheared by said blade, the improvement in said cutting head comprising: a thin panel of rigid material extending parallel to and seated tightly against a side face of said screen, the top edge of said panel abutting said side face of said screen and being parallel with the top surface of said screen and located above the bottom ends of the portions of said screen openings in said sides of said screen and in or below the horizontal plane of the inside surface of the top of said screen for erecting individual hairs into a posture generally normal to the skin as the hairs pass into the openings in the screen for shearing by the blade.

7. In a cutting head for an electric shaver having a thin screen and a driven cutting blade movably mounted within and engaging the inside surface of said screen, the screen having a top surface and a pair of sides, a plurality of openings through the top of said screen, portions of said openings extending down said sides through which individual hairs may pass through said screen to be sheared by said blade, the improvement in said cutting head comprising: a thin panel of rigid material extending parallel to and seated tightly against a side face of said screen, the top edge of said panel abutting said side face of said screen and being parallel with the top surface of said screen and located between the horizontal plane of the bottom ends of the portions of said screen openings in said screen sides and the horizontal plane of the inside surface of the top of said screen for erecting individual hairs into a posture generally normal to the skin as the hairs pass into the openings in the screen for shearing by the blade.

8. The improvement in electric shaver cutting heads as described in claim 7 wherein a pair of said panels are provided, one on each side of said screen and each seated tightly against the adjacent face of said screen.

9. The improvement in electric shaver cutting heads as described in claim 7 wherein said screen is elongated, of inverted U-shape and said openings extend laterally thereof, said panel being elongated and of a length to overlie all openings in said screen side.

10. The improvement in electric shaver cutting heads as described in claim 9 wherein a plurality of said screen-blade combinations are provided, arranged parallel to each other, said panels being provided on each side of each of said screens except one side of one of said screens, said one side being the leading edge of said shaver head when the shaver is moved in one direction.

11. An accessory for an electric shaver having a screen housing a driven cutter blade, the screen having a top and sides and a plurality of slotlike openings in the top thereof and extending down the sides, said accessory comprising: a member of rigid material having a base and integral upstanding side panels forming a channel of a width to snugly receive said screen with said upstanding side panels seated tightly against the sides of said screen, at least one of said side panels having a straight top edge which, when the screen is seated in said member will be in abutment with the adjacent one of said sides of said screen and parallel to the top surface of the screen and located between the horizontal plane of the bottom ends of said portions of the screen openings in the screen sides and the plane of the inside surface of the top of the screen, the juncture of the top face and the outer side face of said side defining a sharp angle.

12. In a cutting head for an electric shaver having a plurality of cutters each having a thin screen and a driven blade movably mounted within and engaging the inside surface of said screen, the screens each having a top surface, a pair of sides and a plurality of openings through the top portions of said openings extending down said sides through which individual hairs may pass through said screens to be sheared by said blades, and a filler-spacer seated between and separating each adjacent pair of said cutters, the improvement in said cutting head comprising: a U-shaped member of thin rigid material having a central channel defined by a pair of sides and a base, said channel receiving said filler-spacer therein with said sides extending above the top of said filler-spacer, when said member is seated between a pair of said cutters, the sides of said member being seated tightly against the sides of the screens of the adjacent cutters, the top edges of said member being parallel with the top surfaces of said screens and located between the horizontal plane of the bottom ends of the portions of said screen openings in said screen sides and the horizontal plane of the inside surfaces of the tops of said screens for erecting individual hairs into a posture generally normal to the skin as the hairs pass into the openings in the screens for shearing by the blades.

13. In a cutting head for an electric shaver having a thin screen and a driven cutting blade movably mounted within and engaging the inside surface of said screen, the screen having a top surface and a pair of sides, a plurality of openings through the top of said screen, portions of said openings extending down said sides through which individual hairs may pass to be sheared by said blade, the improvement in said cutting head comprising: a thin, rigid element seated tightly against a side face of said screen, the top edge of said element being in abutment with the adjacent one of the sides of said screen and parallel with the top surface of said screen and in the same general horizontal plane as the inside surface of the top of said screen and overlying the lower part of those portions of said openings extending down said side of said screen for erecting individual hairs into a posture generally normal to the skin as the hairs pass into the openings in the screen for shearing by the blade; said element being supported against movement with respect to said screen.

* * * * *